United States Patent [19]

Lefevre

[11] 4,052,491

[45] Oct. 4, 1977

[54] MODULAR GAS AND LIQUID CONTACT MEANS

[75] Inventor: Marcel Robert Lefevre, Bernardsville, N.J.

[73] Assignee: Research-Cottrell, Inc., Bound Brook, N.J.

[21] Appl. No.: 700,029

[22] Filed: June 25, 1976

[51] Int. Cl.[2] ..... B01F 3/04

[52] U.S. Cl. ..... 261/112; 261/DIG. 11

[58] Field of Search ..... 261/110–112, 261/DIG. 11, 103, 106, 108, 109, DIG. 72; 210/150, 151

[56] References Cited

U.S. PATENT DOCUMENTS

| | | | |
|---|---|---|---|
| 1,674,764 | 6/1928 | Dauphinee | 261/112 |
| 1,928,912 | 10/1933 | Scherer et al. | 261/103 |
| 2,759,719 | 8/1956 | Odenthal | 261/DIG. 11 |
| 2,977,103 | 3/1961 | Smith et al. | 261/111 |
| 3,116,989 | 1/1964 | Warren | 261/111 X |
| 3,235,234 | 2/1966 | Beaudoin | 261/112 X |
| 3,272,484 | 9/1966 | Brand et al. | 261/112 X |
| 3,430,694 | 3/1969 | Cardell | 261/112 X |

FOREIGN PATENT DOCUMENTS

| | | | |
|---|---|---|---|
| 571,510 | 8/1945 | United Kingdom | 261/DIG. 11 |
| 708,310 | 5/1954 | United Kingdom | 261/112 |

*Primary Examiner*—Tim R. Miles
*Assistant Examiner*—Richard L. Chiesa
*Attorney, Agent, or Firm*—Harold L. Stowel

[57] ABSTRACT

A modular gas and liquid contact member is formed of a plurality of extended surface sheet members with means associated with at least the peripheral margins thereof warping the sheets and maintaining the sheets in an undulated array. In a preferred form of the invention, the means for warping and maintaining the sheet members in the undulated array comprises a plurality of through bolts and spacers of varying lengths threaded on the through bolts and contacting opposed surfaces of adjacent sheet members.

5 Claims, 7 Drawing Figures

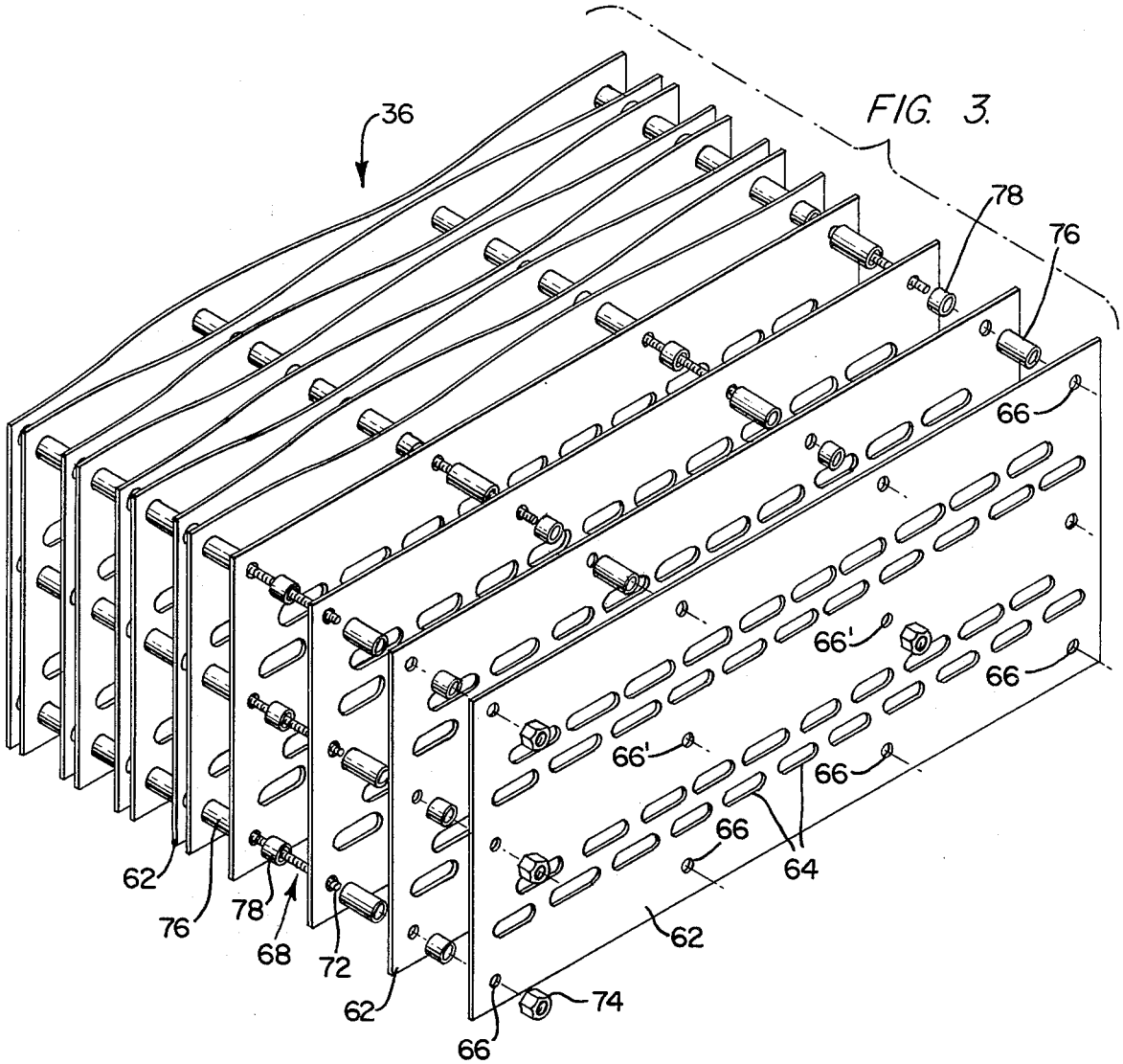
FIG. 3.
FIG. 4.
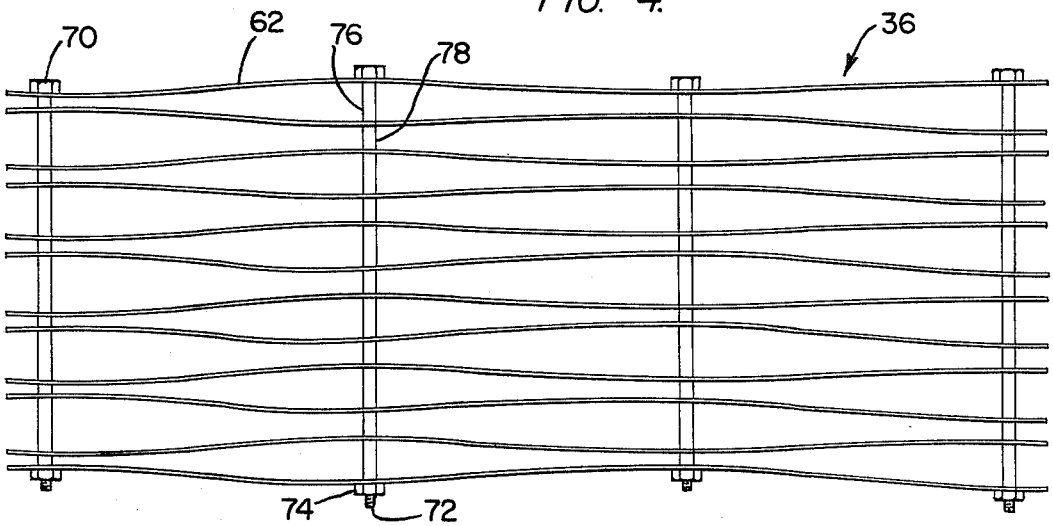

MODULAR GAS AND LIQUID CONTACT MEANS

BACKGROUND OF THE INVENTION

The present invention relates to means for the interface contact of a liquid and a gas and the invention has particular utility in the liquid-gas heat exchange and mass transfer art.

There are many different types of cooling towers such as, for example, the atmospheric open type in which the water to be heated or cooled is sprayed over a structure open to the atmosphere and the chimney type in which the cooling is carried out within an enclosed space with the cooling medium being supplied by natural, induced or forced draft. The draft may be horizontal or vertical and the liquid to be cooled or heated is allowed to pass downwards in such a manner as to present a large surface area to contact with a countercurrent or crosscurrent of the cooling or heating gas, usually air. The air may enter at the bottom of the tower for countercurrent cooling or may be caused to enter the side of the tower where crosscurrent cooling is employed.

In cooling towers it will be apparent that the greater the surface area of a given body of water presented to the cooling air, the more efficient will be the cooling of the water and the attainment of large surface area to volume ratios for the water has been achieved in the prior art in different ways.

For example, large surface areas per unit volume of water have been attained by causing the water to flow downwards as a film over continuous supporting elements thus presenting a large surface area to the current of air. The supporting elements have been stacked together to form what is known in the art as a film-flow packing or fill. In order to support such packing, the interior of the towers were provided with extensive and costly supporting beams to support layers or modules of the filling or packing which supporting beams extend upwardly above the topmost fill and then provide the support for the pipes and spray heads for directing water onto the fill and also the drift eliminators positioned above the piping.

It has also been known to corrugate or place in wave form filling sheets, particularly those of plastic and assemble such sheets into groups, however, while surface area was thus increased, uneven flow of liquid often resulted due to capillary action of the liquid in zones of all lines of contact between the sheets.

It is, therefore, a principal object of the present invention to provide fill or packing for gas and liquid contact apparatus formed from a plurality of extended surface planar sheets which are warped during assembly and maintained in wave form patterns which wave form patterns materially increase the strength of the assembly thereby permitting assembled units or modulars to be stacked one upon the other and to support at the upper end of the fill piping and the like for directing the liquid to be cooled to the fill and to also support drift or mist eliminators.

It is another object of the present invention to provide such modular fill wherein a plurality of sheets are assembled into a unit or modular with no line contact between adjacent sheets to thereby reduce channeling of the cooling liquid and to thereby improve the surface flow of the liquid to be cooled or treated.

It is also an object of the present invention to provide a fill assembly formed of relatively thin material which attains its rigidity by being placed in a wave form pattern by a combination of through bolt and spacer assemblies.

GENERAL DESCRIPTION OF THE PRESENT INVENTION

The present invention may be generally defined as a modular gas-liquid contact member comprising a plurality of sheet members and means associated with at least the peripheral margins thereof warping and maintaining the sheet members in an undulated array and the invention may aso be defined as a modular heat and mass transfer member for gas and liquid contact means comprising a plurality of rectangular sheet members, each of the sheet members having a plurality of cooperating openings therethrough at least adjacent the peripheral margins thereof, an elongated rod through each of the sheet openings of a series of the sheets and spacer members of differing lengths recieved on the rods to maintain the plurality of sheets in a modular of spaced sheets and warping and maintaining the sheets of the modular in an undulated array.

BRIEF DESCRIPTION OF THE DRAWINGS

The invention will be more particularly described and the foregoing and other ojects and advantages will become more apparent to those skilled in the art from the following detailed description of the invention when considered together with the accompanying drawing wherein:

FIG. 3 is a partially exploded detailed perspective view of a unit constructed in accordance with the teachings of the present invention;

FIG. 4 is a top plan view of the assembled unit shown in FIG. 3;

Referring to FIGS. 1 and 2 of the drawings, 10 generally designates a natural draft cooling tower system including a natural draft tower 12 having an open discharge end 14 for cooling air and peripheral air inlets 14'. The flow path of the cooling air is illustrated by directional arrows 16. While this form of natural draft cooling tower is disclosed herein in conjunction with the present invention, it will be appreciated by those skilled in the art that other forms of cooling towers may be equally well employed with the improved modular form gas and liquid contact means and the cooling tower may be a combination natural draft and fan assisted or solely operated by means of cooling fans mounted in or externally of the tower as will be appreciated by those skilled in the art.

Figure 1:
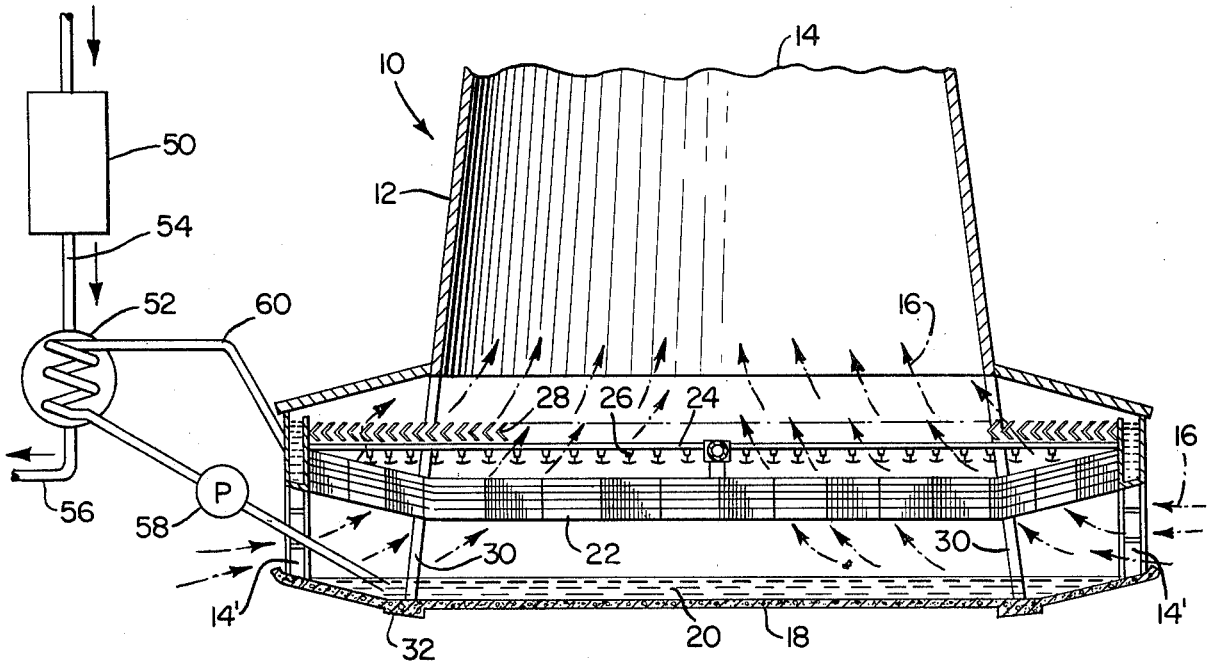
FIG. 1 is a fragmentary, somewhat diagrammatic sectional view of a natural draft cooling tower employing the improved modular fill assemblies of the present invention.

The lower end of the tower 12 contains a sump or basin 18 havng a pool of liquid 20 therein which has been cooled in the tower. Within the tower and above the pool of cooling liquid 20 is the packing or fill 22 forming the major portion of the present invention wherein the major heat exchange takes place between the cooling air and the water to be cooled which fill or packing will be more fully described in reference to FIGS. 2 through 7 hereof.

The water to be cooled is directed to the fill or packing 22 via distribution conduits generally designated 24 having outlet spray nozzles 26 depending therefrom. Above the liquid distribution conduits 24 are drift or hook eliminators 28 which remove particles and droplets of water from the air stream as it passes upwardly in the tower 12 to discharge at the upper open end 14.

Figure 2:
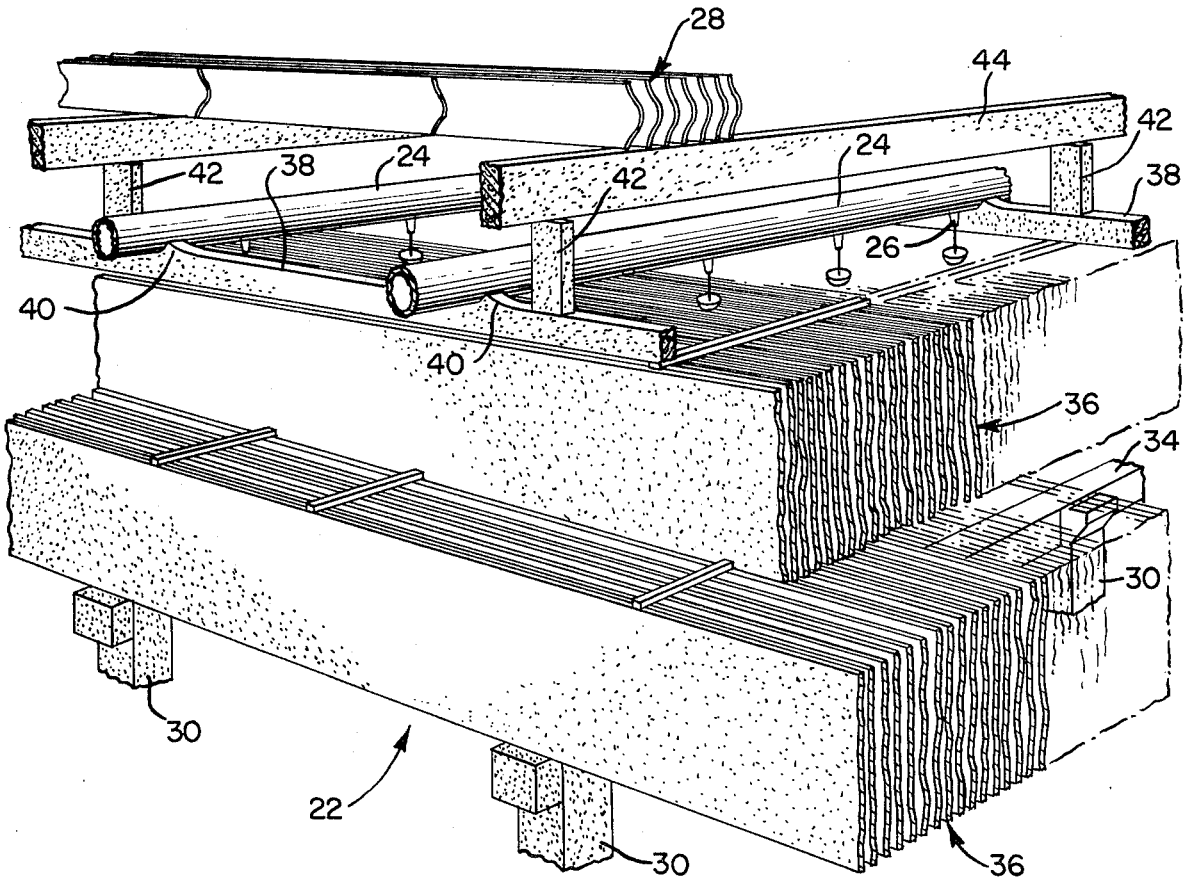
FIG. 2 is an enlarged fragmentary perspective view of a series of the modular units of the present invention together with the conduits for carrying the liquid to be cooled to the fill and drift or mist eliminators for the structures.

The fill 22, the liquid distribution system 24 and the mist eliminators 28 are supported from vertical columns 30 which bear against footings 32 about the base of the tower and transverse beams 34 associated therewith. In view of the material rigidity and strength of the improved fill of the present invention, the modulars generally designated 36 may be stacked one upon the other in generally parallel alignment as illustrated in FIG. 2 or they may be stacked one upon the other with each succeeding modular unit being positioned 90° to that therebelow.

The plurality or network of conduits 24 for the cooling liquid having the depending splash type outlet nozzles 26 are also supported by the uppermost section of the modulars and a convenient method of so supporting the pipes 24 is by means of sleepers 38, the lower surfaces of which rest on the upper surface of the uppermost modulars and the sleepers are provided with cradles 40 to receive the pipes 24. The sleepers 40 are also associated with upstanding beams 42 which support crossbeams 44 which in turn mount the mist or drift eliminators generally designated 28.

From the foregoing, it will be seen that the complex and expensive supporting beams generally required for carrying the weight of plural tiers of gas and liquid contact fill, fluid distribution piping and mist eliminators has been materially reduced, thereby reducing the cost and time of construction of cooling towers from that shown, for example, on pages 4, 5 and 7 of the brochure, "Natural Draft Cooling Towers", Research-Cottrell/Hamon Cooling Tower Division, Copyright 1973, Research-Cottrel, Inc.

The assembly in the illustrated form of the invention includes a turbine 50 which has its exhaust steam connected to a condenser 52 by a conduit 54. The condensed steam is directed by suitable pump means to a boiler, not shown, via conduit 56. The cooling water for the condenser 52 is pumped from the sump 18 via pump 58 and the heated cooling water is directed to the liquid feed distribution network 24 via a conduit 60 and thence is cooled in flowing over the extended surfaces of the fill modules 36 and in its counterflow contact with the air moving through the tower in the direction of the directional arrows 16.

Referring now to FIGS. 3 and 4 showing details of one form of the liquid and gas contact modular 36, the modular is composed of a plurality of preferably rectangular sheets 62. The sheets 62 may be composed of metal, plastic, reinforced plastic, wood, laminated wood and plastic or plastic and metal, or a composition such as asbestos and cement, etc. and the sheets in the illustrated form of the invention are 10 feet in length and 4 feet high and each modular may be, for example, composed of sufficient sheets to provide a finished unit 3 feet in width so that the completed modulars may be readily installed as a unit within the tower structure.

Each of the sheets 62 in the illustrated form of the invention are provided with a number of elongated perforations or slots 64 which slots help to prevent channeling of the liquid to be cooled. Further, the sheets are provided with a plurality of marginal perforations 66 and, where desired, equivalent internal perforation 66'. The openings 66 and 66' are sized to receive conventional through bolts 68 having heads 70 at one end and threaded at the other as indicated at 72 to receive fastening nuts 74.

Each assembly also includes a plurality of spacer members and in the form shown in FIGS. 3 and 4, two sizes of spacer members 76 and 78 are employed with the spacers 76 being about twice the length of spacers 78. Typically, the larger spacers 76 would be from 2 to 15 times larger than the shorter spacers 78. The sheets 62 are assembled together with the through bolts 68 and the spacers 76 and 78 to provide an undulated or waved form to the sheets and the spacers maintain the sheets in the assembled form.

It will be particularly noted that in all instances, a spacer is employed so that there is no face-to-face or line contact between adjacent sheets 62 which would provide a channel or a zone for channeling of the liquid to be cooled. With the sheets so assembled and the nuts and bolts securely tightened, a very strong and rigid assembly is provided even though the thickness of the sheets is relatively small and, for example, from about 0.025 to about 3/16 inch, depending on the material of construction.

Figure 5:
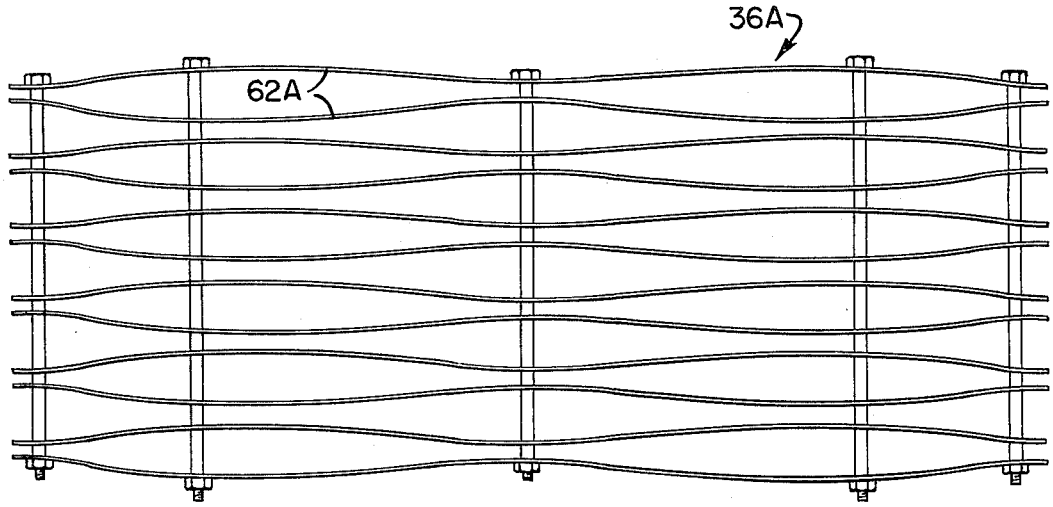
FIG. 5 is a top plan view of a modified form of the present invention.

Referring now to FIG. 5 of the drawing, there is shown in plan another form of the present invention wherein the wave forms are of different lengths with the maximum curvature located near the ends of the sheets 62A where maximum resistance to buckling due to vertical loads is required.

Figure 6:
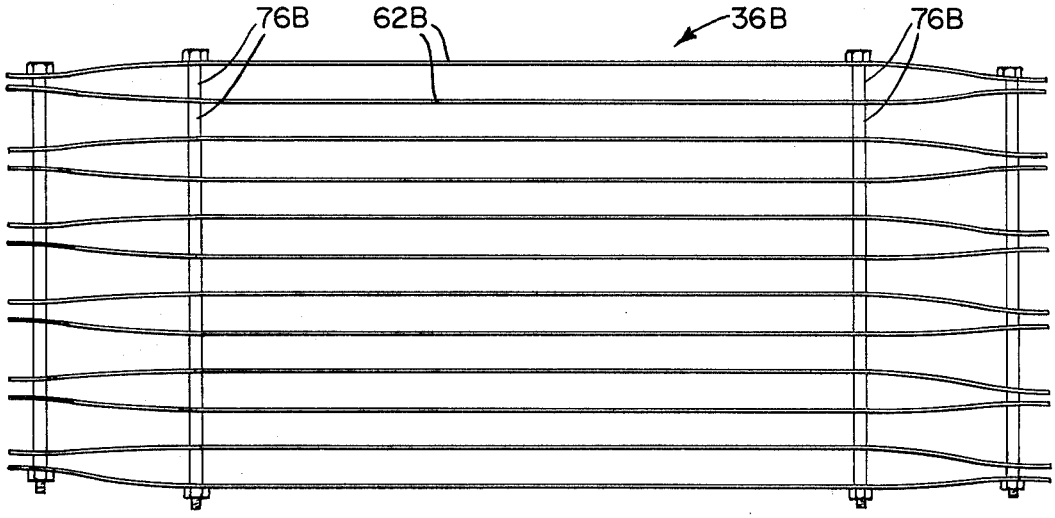
FIG. 6 is a top plan view of still a further form of the present invention.

In FIG. 6, the modular 36B is composed of sheets 62B wherein the wave forms are only used at the ends of the sheets and sheets in the center are maintained in parallel by means of spacers 76B of the same length.

Figure 7:
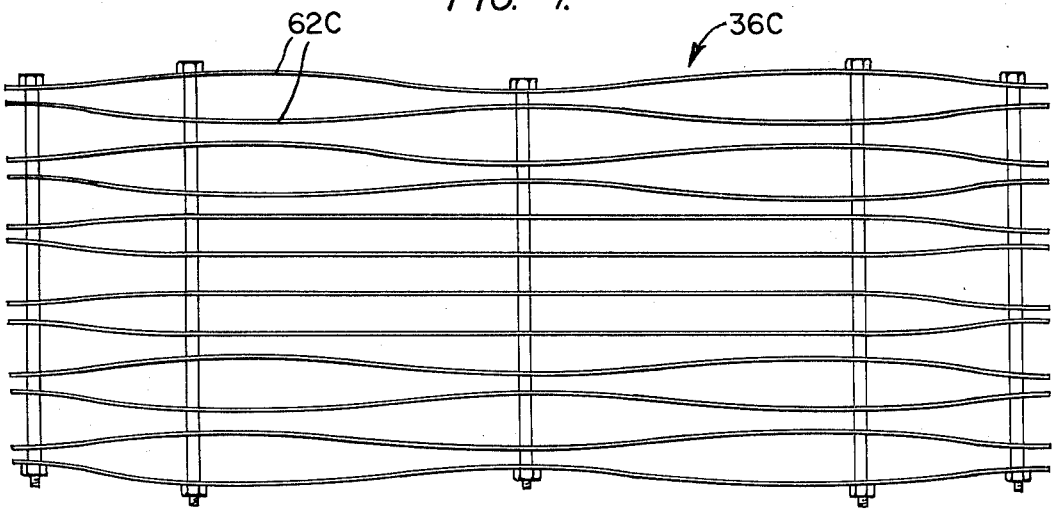
FIG. 7 is a top plan view of another form of the improved gas and liquid contact modular.

Referring now to FIG. 7, the modular 36C is a combination of the modulars shown in FIGS. 5 and 6, that is, the outer sheet members are maintained in a wave pattern throughout their lengths and the center portion of the sheets are in wave form only adjacent their ends and parallel and rectilinear in the center part. This combination presents the advantages of good resistance to buckling as well as lateral stability without being detrimental to the heat transfer process.

From the foregoing description, it will be seen that the present invention provides useful modular form gas and liquid contact means fully accomplishing the aims and objects hereinbefore set forth.

I claim:

1. In a cooling tower having an air inlet at its lower end, an air outlet at its upper end and an air passage extending between the air inlet and the air outlet, gas and liquid contact means in the air passage and liquid distribution means positioned in the air passage above the gas and liquid contact means wherein the gas and liquid contact means comprise a plurality of sheet members, a plurality of sets of spacer members at least at the peripheral margins of the sheet members maintaining the sheet members in side-by-side spaced relationship, at least two sets of the plurality of sets of spacer members having different lengths whereby the sheet members are spaced in an undulated array.

2. In a cooling tower having an air inlet at its lower end, an air outlet at its upper end and an air passage extending between the air inlet and the air outlet, gas and liquid contact means in the air passage and liquid distribution means positioned in the air passage above the gas and liquid contact means wherein the gas and liquid contact means comprise a plurality of rectangular sheet members, each of said sheet members having a plurality of cooperating openings therethrough at least adjacent the peripheral margins thereof, an elongate rod through each of said sheet openings of a series of said sheets and spacer members of differing lengths received on said rods to maintain said plurality of sheets in a modular of spaced sheets and warping and maintaining the sheets of the modular in an undulated array.

3. The invention defined in claim 2 wherein each of said arrays have lengths in the order of about 10 feet, height in the order of about 4 feet, and a number of sheets to provide a modular of about 3 feet in width.

4. The invention defined in claim 3 wherein the sheets comprise a combination of cement and asbestos.

5. The invention defined in claim 3 wherein the sheets comprise plastic.

* * * * *